US007234800B2

(12) United States Patent
Watanabe et al.

(10) Patent No.: US 7,234,800 B2
(45) Date of Patent: Jun. 26, 2007

(54) INKJET RECORDING APPARATUS

(75) Inventors: Itaru Watanabe, Yokohama (JP); Shigeru Watanabe, Yokohama (JP); Tetsuo Kikuchi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 11/050,541

(22) Filed: Feb. 3, 2005

(65) Prior Publication Data

US 2005/0174403 A1 Aug. 11, 2005

(30) Foreign Application Priority Data

Feb. 9, 2004 (JP) ..... 2004-031990

(51) Int. Cl.
*B41J 2/175* (2006.01)

(52) U.S. Cl. ..... 347/85

(58) Field of Classification Search ..... 347/84, 347/85, 86, 87; 141/2, 18
See application file for complete search history.

(56) References Cited

U.S. PATENT DOCUMENTS

| | | | | |
|---|---|---|---|---|
| 4,419,678 | A * | 12/1983 | Kasugayama et al. | 347/86 |
| 6,022,102 | A * | 2/2000 | Ikkatai et al. | 347/85 |
| 6,520,630 | B1 * | 2/2003 | Oda et al. | 347/85 |
| 6,612,689 | B2 * | 9/2003 | Suenaga et al. | 347/85 |
| 6,702,433 | B2 | 3/2004 | Kono | |
| 6,969,161 | B2 * | 11/2005 | Kuwabara et al. | 347/85 |
| 7,118,204 | B2 * | 10/2006 | Hatasa et al. | 347/86 |

* cited by examiner

*Primary Examiner*—Anh T. N. Vo
(74) *Attorney, Agent, or Firm*—Canon U.S.A. Inc. I.P. Div

(57) ABSTRACT

In an inkjet recording apparatus in which a single ink supply path for hermetically sealing an ink tank and a recording head from the atmosphere is formed by connecting the ink tank to first and second hollow needles. When the ink tank is detached, the flow path is sealed in association with mounting and dismounting of the ink tank, thereby leakage of ink to the outside of the apparatus is prevented.

6 Claims, 5 Drawing Sheets

INKJET RECORDING APPARATUS

BACKGROUND OF THE INVENTION

1. Field of the Invention

The present invention relates to an inkjet recording apparatus, and more particularly, to an inkjet recording apparatus on which an ink tank can be detachably mounted.

2. Description of the Related Art

In recording systems such as a printer and the like, an inkjet recording system, which performs recording on a to-be-recorded medium such as a recording sheet and the like by ejecting ink from ejection ports (nozzles), has recently been widely employed because it is a low-noise, non-impact recording system and can execute a recording operation at very high densities and at high speeds.

A typical inkjet recording apparatus includes a drive means for driving a carrier on which an inkjet head is mounted, a transportation means for transporting a recording sheet, and a control means for controlling the drive means and transportation means. In the inkjet recording apparatus arranged as described above, it is important to prevent leakage of ink from an ink supply path.

As a means for this purpose, Japanese Patent Laid-Open No. 2002-234180 (corresponding U.S. Pat. No. 6,702,433) discloses an ink supply device for supplying ink from a detachable ink tank having two liquid connectors in its lower portion. The ink supply device is arranged such that a hollow needle, which communicates with an ink supply path for supplying the ink to a recording head, is inserted into and communicates with one of the liquid connectors. Another hollow needle, which communicates with a bottom portion of an atmosphere communication chamber communicating with the atmosphere through an atmosphere communication port, is inserted into and communicates with the other liquid connector. Thereby, the portion from the atmosphere communication port to the atmosphere communication chamber is arranged as a single flow path hermetically sealed to the atmosphere. According to this arrangement, leakage of ink from the atmosphere communication port communicating with the ink tank can be suppressed while keeping the pressure of the liquid supplied to the recording head approximately constant.

In the conventional example, however, when the detachable ink tank is removed in a state that the atmosphere communication chamber is filled with the ink, the passage from the hollow needle to the atmosphere communication port is opened to the atmosphere at both ends thereof. Accordingly, when the main body of an inkjet recording apparatus is inclined in transportation and the like, there is a possibility that the ink in the atmosphere communication chamber spills and gets the inkjet recording apparatus dirty.

SUMMARY OF THE INVENTION

The present invention is directed to an inkjet recording apparatus capable of suppressing an unintentional leakage of ink from a liquid supply path in the recording apparatus even if an ink tank is removed.

In one aspect of the present invention, an inkjet recording apparatus includes a detachable ink tank adapted to accommodate ink; a recording head; an ink supply path coupled to the recording head; an atmosphere communication portion communicating with an atmosphere; first and second hollow needles, wherein the ink tank is configured to attach to and detach from the first and second hollow needles, wherein in an attached state in which the ink tank is attached to the first and second needles, the atmosphere communication portion communicates with the ink tank via the second hollow needle and the ink supply path communicates with the ink tank via the first hollow needle so that a single flow hermetically sealed path is provide between the recording head to the atmosphere communication portion; and a first switching valve sealing the first hollow needle from the ink supply path in a detached state in which the ink tank is detached from the first and second hollow needles.

In the inkjet recording apparatus, the atmosphere communication portion can be hermetically sealed to the atmosphere except an atmosphere communication port of the atmosphere communication portion when the ink tank is detached. Accordingly, even if the ink tank is removed while the recording apparatus is being used and the recording apparatus is moved, the ink in the atmosphere communication portion does not leak from the atmosphere communication port.

As described above, according to the present invention, even if a replacable ink tank is replaced in a state that ink is accommodated in the atmosphere communication portion, the path from the recording head to the first hollow needle or the path from the atmosphere communication port to the second hollow needle is hermetically sealed in its midway by a valve. Thus, even if an inkjet recording apparatus main body is inclined, leakage of ink to the outside can be suppressed.

Further, since the valve is opened and closed in association with attaching/detaching of the ink tank, the inkjet recording apparatus can be used at all times in a state in which there is no possibility of leakage of ink without a special manipulation of a user.

Further features and advantages of the present invention will become apparent from the following description of the exemplary embodiments (with reference to the attached drawings).

BRIEF DESCRIPTION OF THE DRAWINGS

FIGS. 2A and 2B are schematic views explaining an ink supply path of the inkjet recording apparatus shown in FIG. 1, wherein FIG. 2A shows a state in which an ink tank is mounted on a main body, and FIG. 2B shows a state in which the ink tank is removed from the main body.

FIGS. 3A to 3C are schematic views explaining an ink supply path of an inkjet recording apparatus of a second embodiment of the present invention, wherein FIG. 3A shows a state in which an ink tank is mounted on a main body, FIG. 3B shows a state in which the ink tank is removed from the main body, and FIG. 3C is a sectional view showing a first hollow needle in detail.

FIGS. 4A and 4B are schematic views explaining an ink supply path of an inkjet recording apparatus of a third embodiment of the present invention, wherein FIG. 4A shows a state in which an ink tank is mounted on a main body, and FIG. 4B shows a state in which the ink tank is removed from the main body.

FIGS. 5A to 5C are views explaining ink supply paths of an inkjet recording apparatus of a fourth embodiment of the present invention, wherein FIG. 5A shows a state in which an ink tank is mounted on a main body, FIG. 5B shows a state in which the ink tank is removed from the main body, and FIG. 5C shows a cross section of an atmosphere communication path in a dotted-line portion in FIG. 5B.

DESCRIPTION OF THE EMBODIMENTS

Embodiments of the present invention will be explained below with reference to the drawings.

First Embodiment

Figure 1:
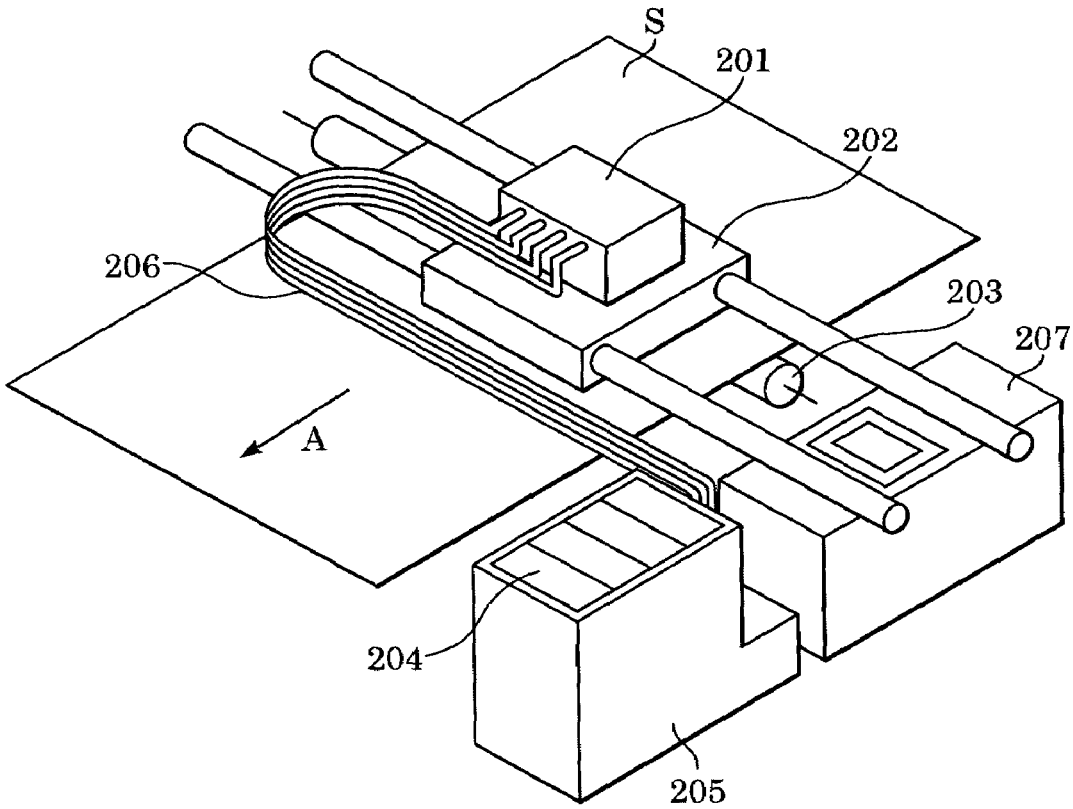
FIG. 1 is a perspective view of an inkjet recording apparatus of a first embodiment of the present invention.

FIG. 1 is a perspective view of an inkjet recording apparatus of a first embodiment of the present invention.

The inkjet recording apparatus shown in FIG. 1 is a serial type recording apparatus for forming characters, symbols, images, and the like by repeating the reciprocating movement (main scan) of a recording head 201 and the transportation (sub-scan) of a recording sheet S such as an ordinary recording sheet, a special sheet, an OHP film, and the like at a predetermined pitch, selectively ejects ink from the recording head 201 in synchronism with the above movements, and causing the ink to adhere on the recording sheet S.

In FIG. 1, the recording head 201 is detachably mounted on a carriage 202 which is slidably supported by two guide rails and reciprocatingly moved along the guide rails by a drive mechanism such as a not shown motor, and the like. The recording sheet S is transported in a direction intersecting the moving direction of the carriage 202 (for example, the direction of arrow A orthogonal to the moving direction of the carriage 202) by a transportation roller 203 such that the recording sheet S confronts the ink ejecting surface of the recording head 201 as well as the distance therebetween is kept constant.

The recording head 201 has a plurality of nozzle trains for ejecting different color inks. A plurality of independent main tanks 204 are detachably attached in an ink supply unit 205 in correspondence to the colors of the ink ejected from the recording head 201. The ink supply unit 205 is connected to the recording head 201 through a plurality of ink supply tubes 206 corresponding to the colors of the respective inks. The inks of the respective colors accommodated in the main tanks (ink tanks) 204 can be independently supplied to the respective nozzle trains of the recording head 201 by attaching the main tanks 204 in the ink supply unit 205.

A recovery unit 207 is disposed to confront the ink ejecting surface of the recording head 201 within the reciprocating moving range of the recording head 201 as well as within a non-recording region external to the range in which the recording sheet S passes.

Figure 2A:
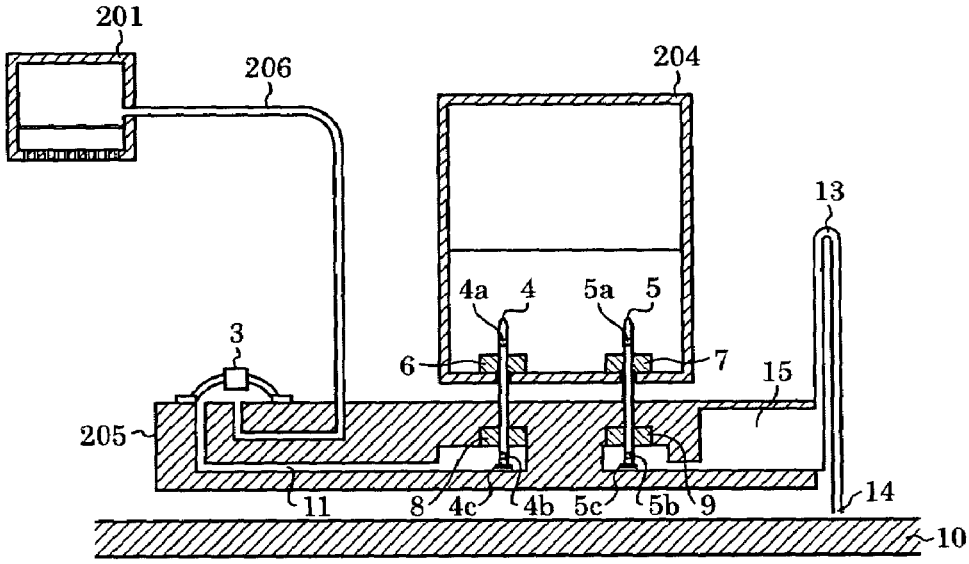
Figure 2B:
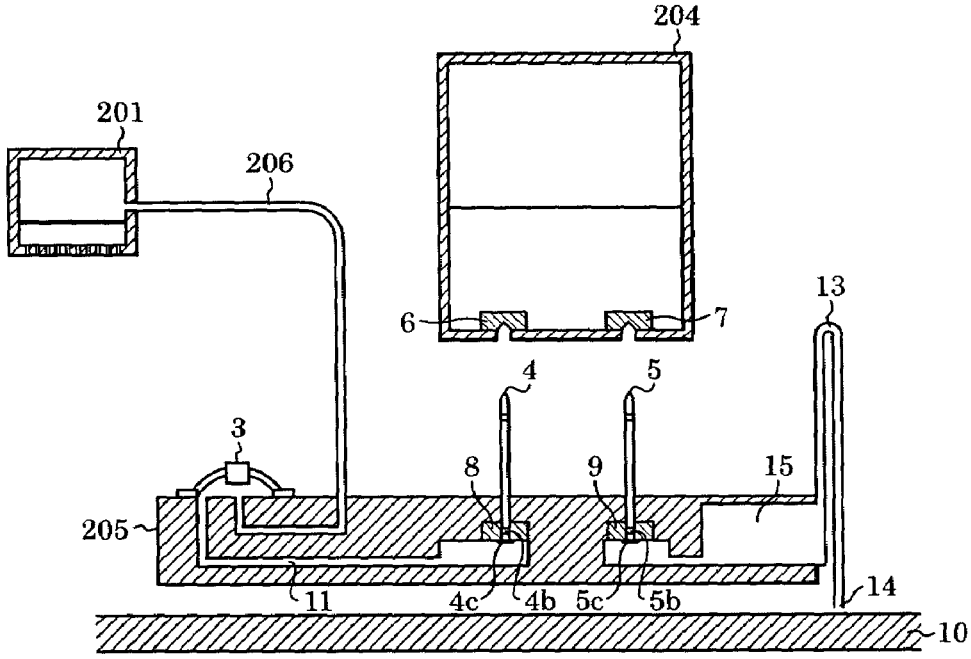

Next, a detailed arrangement of an ink supply system of the inkjet recording apparatus shown in FIG. 1 will be explained using FIGS. 2A and 2B. FIGS. 2A and 2B are schematic views explaining an ink supply path of the inkjet recording apparatus shown in FIG. 1, wherein FIG. 2A shows a state in which the ink tank is mounted on a main body, and FIG. 2B shows a state in which the ink tank is removed from the main body. To simplify explanation, FIGS. 2A and 2B show only one ink supply path for one color ink.

In FIGS. 2A and 2B, a valve 3 is disposed midway between ink supply paths 206 and 11 to the recording head 201 and is used to increase negative pressure in the recording head. An ink supply needle 4, that is, a first hollow needle 4, is disposed at an end of the ink supply path 11. A hole 4*a* and a hole 4*b* are formed in an upper portion and a lower portion of a side surface of the first hollow needle 4.

In contrast, an ink supply needle 5, that is, a second hollow needle 5, is inserted into a main tank 204 together with the first hollow needle 4, and a hole 5*a* and a hole 5*b* are formed in an upper portion and lower portion of a side surface of the second hollow needle 5. The second hollow needle 5 is connected to an atmosphere communication chamber 15 which communicates with the atmosphere through an atmosphere communication path 13 having an atmosphere communication port 14 at an end.

Rubber stoppers 6 and 7 are disposed to the main tank 204, and seal members 9 and 8 come into contact with the first and second hollow needles 4 and 5, respectively. The first and second hollow needles 4 and 5 are slidable with respect to the seal members 8 and 9 which prevent a liquid from flowing from the portion other than the first and second hollow needles 4 and 5. In contrast, since the first and second hollow needles 4 and 5 have flanges 4*c* and 5*c* disposed to the lower ends thereof, even if they are pulled upward, they are not extracted from the seal members. Further, even if the first and second hollow needles 4 and 5 are forcibly inserted downward, they are not extracted downward from the seal members because the flanges come into contact with the flow path wall of the ink supply unit 205.

Note that a waste ink absorbing member 10 is disposed below the end of the atmosphere communication path 13 on the side thereof communicating with the atmosphere.

As shown in FIG. 2A, when the main tank 204 as the ink tank is attached in the ink supply unit 205, the first and second hollow needles 4 and 5 are inserted through the rubber stoppers 6 and 7, respectively, and the holes 4*a* and 5*a* at the ends thereof are located in the main tank 204. At the time, the hole 4*b* and 5*b* of the first and second hollow needles 4 and 5 at the other ends thereof communicate with the ink supply path 11 and the atmosphere communication chamber 15, respectively. Accordingly, the portion from the atmosphere communication port 14 to the ink supply paths 11 and 206 constitutes a single flow path hermetically sealed to the atmosphere as that shown Japanese Patent Laid-Open No. 2002-234180.

In contrast, FIG. 2B shows a state in which the main tank 204 is removed. The first hollow needle 4 is held with an appropriate tightening force by the rubber stopper 6 of the main tank 204 and the seal member 8. However, since the holding force of the rubber stopper 6 is set as large as or somewhat smaller than that of the seal member 8, when it is intended to extract the main tank 204 upward, the first hollow needle 4 is moved upward while keeping the positional relation between the first hollow needle 4 and the rubber stopper 6. Thereafter, when the flange 4*c* at the lower end of the first hollow needle 4 is abutted against the seal member 8, the movement of the first hollow needle 4 is prevented by the flange 4*c*, thereby the first hollow needle 4 is extracted from the main tank 204. Likewise, the second hollow needle 5 is also extracted from the main tank 204 after the flange 5*c* at the lower end of the second hollow tube 5 is abutted against the seal member 9.

Accordingly, when the main tank 204 is removed, the holes 4*b* and 5*b* in the lower portions of the first and second hollow needles 4 and 5 are blocked by the seal members 8 and 9, respectively. Further, the first and second hollow needles 4 and 5 are held in parallel with the extracting direction of the main tank 204 by the seal members 8 and 9 and guide members (not shown).

Accordingly, the ink supply paths 206 and 11 from the recording head 201 to the seal member 8 are in a hermetically sealed state except the meniscus at the nozzle outlets of the recording head 201, and thus the ink in the ink supply paths 206 and 11 is placed in a stationary state. According to an experiment, the meniscus formed to the ultra-thin tubes of the recording head and the like was so strong that they were not broken even by a vibration having an impact acceleration of about 2 G. Even if the meniscus of the recording head 201 are broken, since a cap (not shown) is disposed on a nozzle surface of the recording head 201 to entirely cover it, the ink spilled from the nozzles does not leak to the outside. Further, even if the volume of ink is expanded to a certain extent by a change of temperature and atmospheric pressure, the expanded volume of the ink can be held by the meniscus force of the recording head 201. Even if the expanded volume of the ink cannot be held by the meniscus force and the meniscus is broken, the ink does not leak to the outside.

On the other hand, the atmosphere communication chamber 15 and the atmosphere communication path 13 are also placed in a stationary state because the second hollow needle 5 is blocked by the seal member 9.

When it is intended to mount the main tank 204 again from this state, the first and second hollow needles 4 and 5 are abutted against the rubber stoppers 6 and 7 in the lower portion of the main tank 204. As described above, the holding forces (friction resistances) of the rubber stoppers 6 and 7 to the first and second hollow needles 4 and 5 are set as large as or somewhat smaller than those of the seal members 8 and 9 thereto. When the first and second hollow needles 4 and 5 are inserted into the rubber stoppers 6 and 7, a drag force is produced. Thus, at first, the first and second hollow needles 4 and 5 are not inserted into the rubber stoppers 6 and 7 and slide through the seal members 8 and 9. Thereafter, when the flanges at the lower ends of the first and second hollow needles 4 and 5 are abutted against the bottom surface of the ink supply path 11 and the atmosphere communication chamber 15, they break the rubber stoppers 6 and 7 and insert into the main tank 204.

As described above, even if the main body is transported while inclined in any direction, ink is prevented from leaking to the outside of the main body by the simple arrangement regardless that the main tank is mounted or not. Likewise, the ink does not leak to the outside of the main body even if a temperature, an atmospheric pressure, and the like change.

Second Embodiment

Figure 3A:
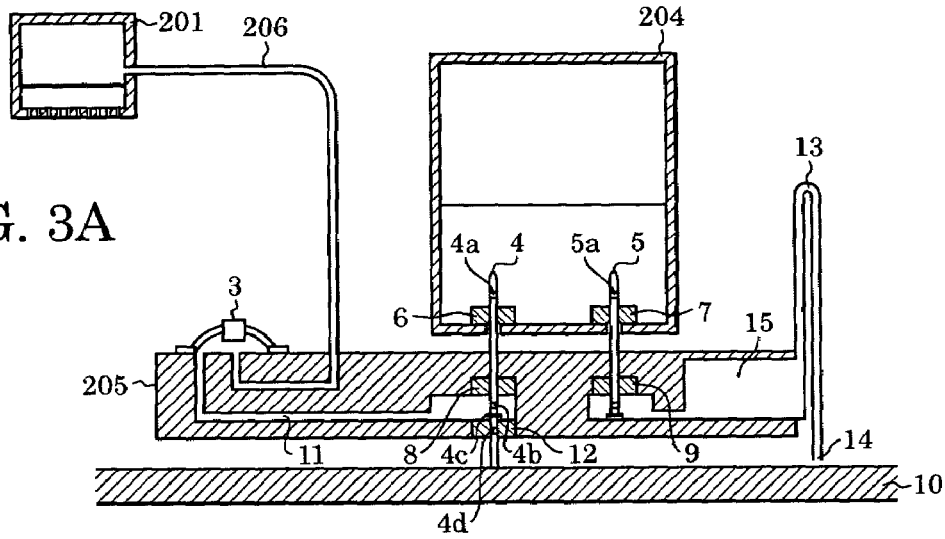
Figure 3B:
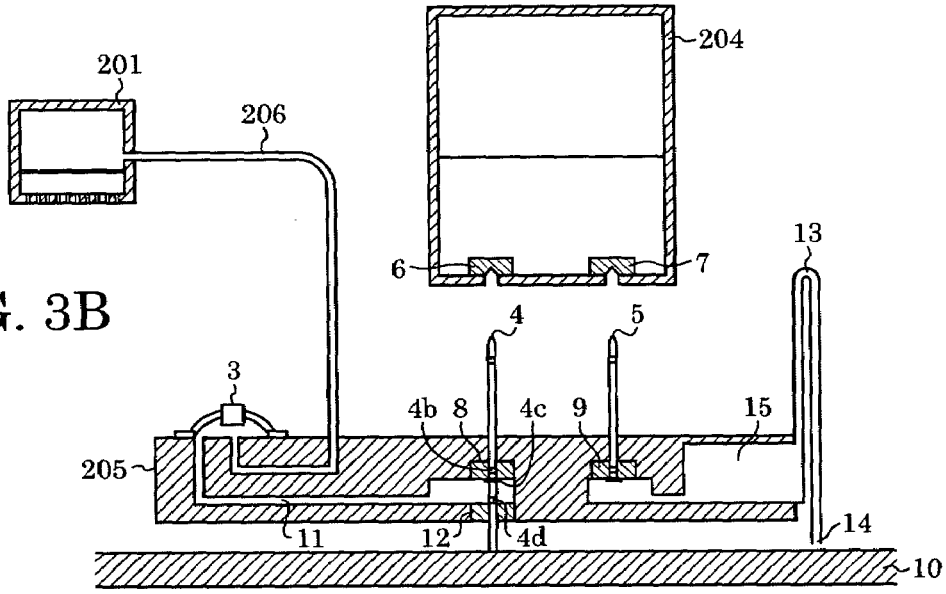
Figure 3C:
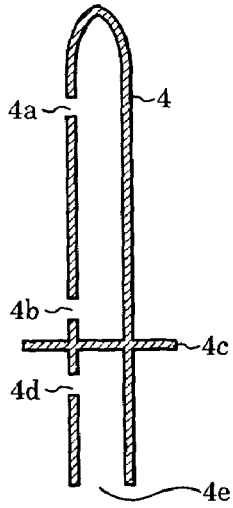

FIGS. 3A to 3C are schematic views explaining an ink supply system of a second embodiment of the present invention, wherein FIG. 3A shows a state in which an ink tank is mounted on a main body, FIG. 3B shows a state in which the ink tank is removed from the main body, and FIG. 3C is a sectional view showing a second hollow needle in detail. The portions of the second embodiment having the same functions as those of the first embodiment described above are denoted by the same reference numerals, and the explanation thereof is omitted.

In the second embodiment, a first hollow needle 4 is divided into two portions by a flange 4*c* as shown in FIG. 3C. A hole 4*a* communicates with a hole 4*b*, and a hole 4*d* communicates with a hole 4*e* through the first hollow needle 4, respectively. A seal member 12 is disposed on a bottom surface of an ink supply path 11, and the portion of the first hollow needle 4 under the flange 4*c* (holes 4*d* and 4*e* side) can slide through the seal member 12.

In the second embodiment, when a main tank 204 is mounted, the hole 4*d* is blocked by the seal member 12 as shown in FIG. 3A. Accordingly, the portion from an atmosphere communication port 14 to the ink supply path 11 and an ink supply path 206 constitutes a single flow path hermetically sealed to the atmosphere as that shown in Japanese Patent Laid-Open No. 2002-234180.

Whereas, when the main tank 204 is removed, the first hollow needle 4 is moved upward while keeping the positional relation between the first hollow needle 4 and a rubber stopper 6 as shown in FIG. 3B, similar to the first embodiment. Thereafter, when the flange 4*c* provided with the first hollow needle 4 is abutted against a seal member 8, the first hollow needle 4 is extracted from the rubber stopper 6 of the main tank 204. Likewise, a second hollow needle 5 is also extracted from a rubber stopper 7 of the main tank 204. At the time, the hole 4*b* of the first hollow needle 4 and a hole 5*b* of the second hollow needle 5 are blocked by the seal member 8 and a seal member 9, respectively. In contrast, since the hole 4*d* of the first hollow needle 4 is located in the ink supply path 11, the ink supply path 11 communicates with the atmosphere through the holes 4*d* and 4*e*. Since a meniscus is formed to the hole 4*e* of the first hollow needle 4 by ink, the ink supply paths 206 and 11 from a recording head 201 to the seal member 8 is placed in a stationary state by the meniscus force of the nozzles of the recording head 201 and the meniscus force of the hole 4*e*. When a vibration and a shock are applied to ink, which is placed in the stationary state by the balance of the two meniscus forces, no ink leaks from the recording head 201 having a stronger meniscus force (meniscus force is stronger in a thinner tube), and ink leaks from the hole 4*e* having a weaker meniscus force. However, no problem arises because the leaked ink is introduced to a waste ink absorbing member 10.

The second embodiment is provided with an opening formed between the recording head 201 and the ink supply paths 206 and 11 to introduce ink into the waste ink absorbing member 10 when the main tank 204 is not mounted, in addition to the arrangement of the first embodiment described above. Accordingly, when the pressure in the ink supply paths 206 and 11 is increased by a change of environment (temperature, atmospheric pressure, and the like) in transportation, the ink can be discharged into the waste ink absorbing member 10. As a result, the second embodiment can achieve a particular effect of eliminating a possibility that the ink in the main tank 204 is caused to flow out from the second hollow needle 5 by the abnormal pressure in the ink supply paths 206 and 11 even if the main tank 204 is mounted, in addition to the effect of the first embodiment.

Note that, in the second embodiment, the first hollow needle 4 need not be composed of a single component and may be composed of two components divided by flanges, and the flanges may be abutted against each other at all times by being pressed by a spring, and the like from the holes 4*d* and 4*e* sides. However, it is possible to securely introduce and to shut off the atmosphere into and from the ink paths 206 and 11 in association with mounting/dismounting of the main tank 204 with a simple arrangement by composing the first hollow needle 4 of the single component as in the second embodiment.

Third Embodiment

Figure 4A:
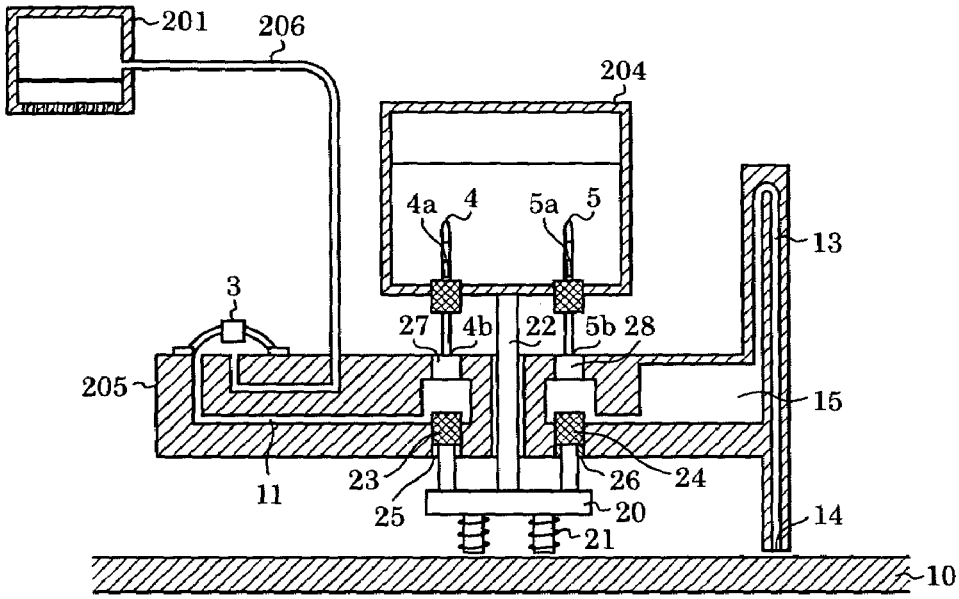
Figure 4B:
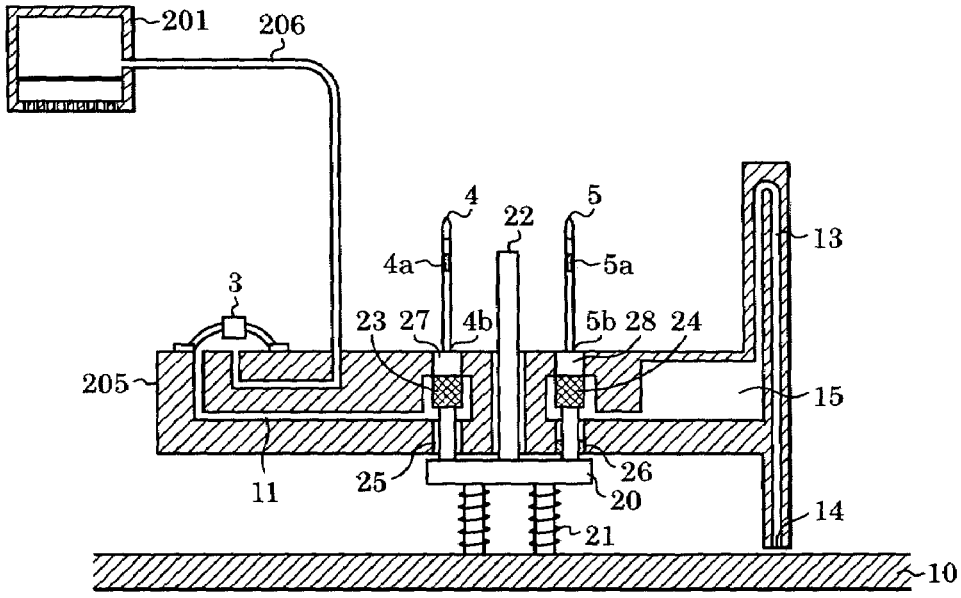

FIGS. 4A and 4B are schematic views explaining an ink supply system of a third embodiment of the present invention, wherein FIG. 4A shows a state in which an ink tank is mounted on a main body, and FIG. 3B shows a state in which the ink tank is removed from the main body. The portions of the third embodiment having the same functions as those of the first and second embodiments described above are denoted by the same reference numerals, and the explanation thereof is omitted.

In the fourth embodiment, a valve is arranged differently from those of the first and second embodiments described above. A first hollow needle 4 communicates with a space 27 at an end of an ink supply path 11 through a hole 4*b*, whereas a second hollow needle 5 communicates with a space 28 at an end of an atmosphere communication chamber 15 through a hole 5*b*. An ink supply unit 205 includes a movable plate 20 which can be slid by elastic bodies 21 such as springs, and the like. The movable plate 20 is provided with a shaft 22 for transmitting a force for actuating the movable plate 20 when the main tank 204 as the ink tank is mounted and with rubber stoppers 23 and 24. When the movable plate 20 is actuated, the rubber stopper 23 acts as a switching valve for switching whether the ink supply path 11 is caused to communicate with an atmosphere port 25 or with the first hollow needle 4, and the rubber stopper 24 acts as a switching valve for switching whether or not the atmosphere communication chamber 15 is caused to communicate with the second hollow needle 5 in association with a seal member 26.

When the main tank 204 is mounted as shown in FIG. 4A, the movable plate 20 is pressed by the bottom of the main tank 204 via the shaft 22 to thereby compress the elastic bodies 21. The main tank 204 is abutted against a stopper (not shown) by the reaction force generated by the elastic bodies 21, thereby the main tank 204 is fixed at the position thereof. At the time, the rubber stoppers 23 and 24 are moved downward in association with the movable plate 20, the hole 4*b* is caused to communicate with the space 27 by the seal member 23 and the atmosphere port 25 is sealed, thereby the flow path from a recording head 201 to the end of the first hollow needle is hermetically sealed from the atmosphere. Since the rubber stopper 24 is located at the position shown in FIG. 4A, the hole 5*b* communicates with the space 28, and the flow path from the hole 5*a* to an atmosphere communication port 14 is hermetically sealed except at the atmosphere communication port 14. The rubber stoppers 23 and 24 are arranged to have a diameter slightly larger than that of the communication paths and to block the communication paths by sealing them with O-rings. As a result, the portion from the atmosphere communication port 14 to the ink supply path 11 and an ink supply path 206 constitutes a single flow path hermetically sealed to the atmosphere as that shown Japanese Patent Laid-Open No. 2002-234180.

As shown in FIG. 4B, when the main tank 204 is removed, the movable plate 20 is pressed upward by the elastic bodies 21 so that the rubber stopper 23 moves upward to seal the space 27 and to open the atmosphere port 25. With the above arrangement, the flow path from the recording head 201 to the ink supply paths 206 and 11 is opened at an end thereof through the atmosphere port 25. In contrast, since the rubber stopper 24 seals the space 28, an end of the atmosphere communication chamber 15 is hermetically sealed by the seal member 26 and the rubber stopper 24, and the atmosphere communication port 14 is opened. Accordingly, the third embodiment can achieve the same effect as that of the second embodiment.

Further, in the first and second embodiments, since the hollow needles 4 and 5 slide through the seal members 6 and 7, the material of the seal members must be selected so that the seal members achieve their function even if the main tank is mounted and dismounted repeatedly. However, the above effect can be securely achieved even if the main tank is mounted and dismounted repeatedly by arranging the valves together with the ink supply paths and the atmosphere communication chamber by attaching the rubber stoppers to the movable plate as in the third embodiment.

Fourth Embodiment

Figure 5A:
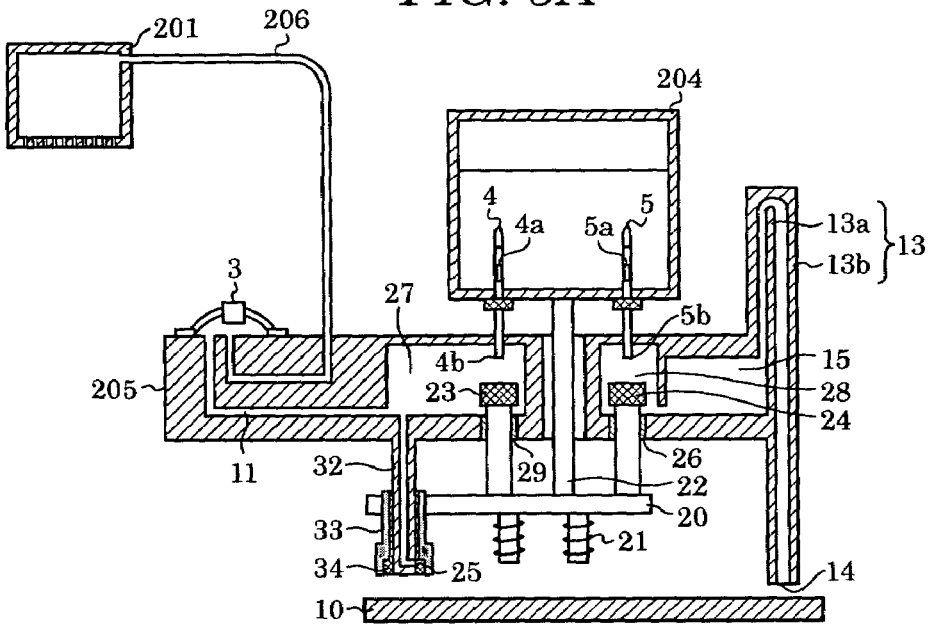
Figure 5B:
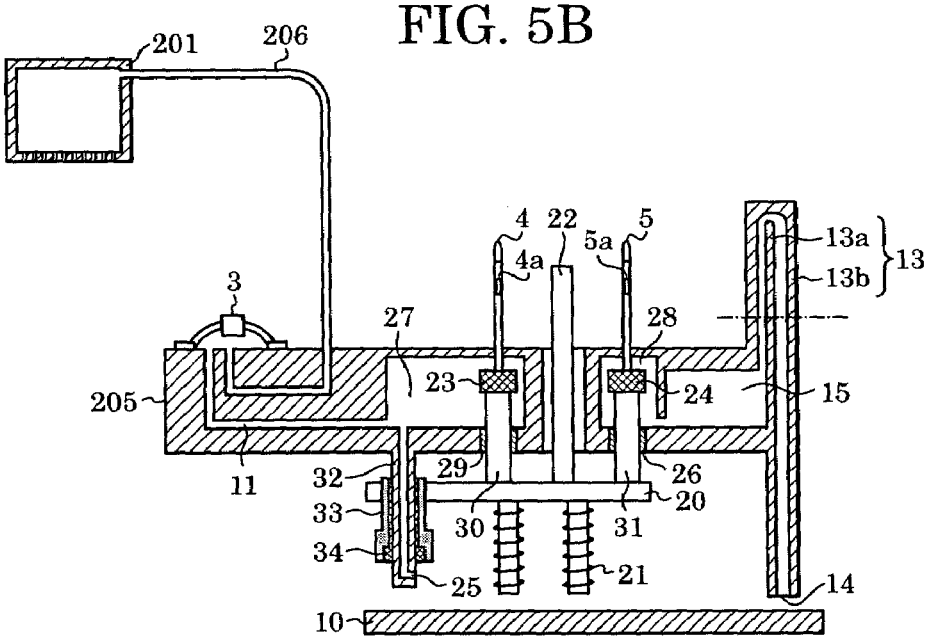
Figure 5C:
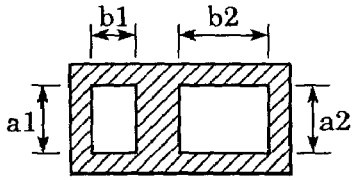

FIGS. 5A to 5C are schematic views explaining ink supply paths of an inkjet recording apparatus of a fourth embodiment of the present invention, wherein FIG. 5A shows a state in which an ink tank is mounted on a main body, FIG. 5B shows a state in which the ink tank is removed from the main body, and FIG. 5C is a sectional view showing an atmosphere communication path. The portions of the fourth embodiment having the same functions as those of the third embodiment described above are denoted by the same reference numerals, and the explanation thereof is omitted.

In the fourth embodiment, the structure of an atmosphere port 25 and the structure of an atmosphere communication path 13 are different from those of the third embodiment.

In the fourth embodiment, first and second hollow needles 4 and 5 have open ends 4*b* and 5*b* as well as openings 4*a* and 5*a* at the portions thereof inserted into the main tank 204, similar the third embodiment. The ends 4*b* and 5*b* project into spaces 27 and 28 of an ink supply unit 205, respectively, and are blocked by seal members 23 and 24 which are disposed at ends of shafts 30 and 31 attached to a movable plate 20 and abutted against the ends 4*b* and 5*b*. The shafts 30 and 31 are arranged to slide with respect to the ink supply unit 205, and the connecting portions thereof connected to the spaces 27 and 28 are provided with seal members 26 and 29 so that no ink leaks from the connecting portions.

The space 27 communicates with a liquid path 11 from a recording head 201 to the main tank 204 and is provided with a third hollow pipe 32 having an atmosphere port 25, in addition to the liquid path 11. The third hollow pipe 32 opens the space 27 to the atmosphere through the atmosphere port 25 when the main tank 204 is not mounted. The third hollow pipe 32 has a pipe 33 slidably fitted thereon. The movable plate 20 is attached to the outer periphery of the pipe 33. The atmosphere port 25 can be sealed by a seal member 34 at an end of the pipe 33. In the fourth embodiment, the portion constituting the valve may be composed of a diaphragm in place of the arrangement described above.

When the main tank 204 is mounted, since the shaft 22 is pressed, the movable plate 20 is moved downward as shown in FIG. 5A, thereby a hermetically sealed path is formed from the recording head 201 to an atmosphere communication port 14 through the main tank 204. In contrast, when the main tank 204 is removed, the recording head 201 communicates with the atmosphere port 25 as shown in FIG. 5B, whereas only the atmosphere communication port 14 is opened in an atmosphere communication chamber 15.

Further, in the fourth embodiment, an inverted-U-shaped atmosphere communication path 13 is connected to the atmosphere communication chamber 15 as shown in FIG. 5C so that the sectional area of a second flow path 13*b*, which connects a first flow path 13*a* to the atmosphere communication port 14, is larger than that of the first flow path 13*a* which extends to a position higher than a connector of the main tank 204.

Specifically, as shown in FIG. 5C, the cross sections of the first and second flow paths 13*a* and 13*b* are formed in an approximately rectangular shape (corners are not formed in an edge and includes an R-shape), and when the cross sectional area of the first flow path 13*a* is shown by S1 and the cross sectional area of the second flow path 13*b* is shown by S2, these areas are set to satisfy a relation 2S1≦S2. Further, in the first and second flow paths 13*a* and 13*b*, when the lengths of the sides in contact with confronting flow paths are shown by a1 and a2, respectively, and the lengths of the other sides are shown by b1, and b2, respectively, a1, a2, b1, and b2 are set to satisfy relations a1≦a2 and 2b1≦b2.

With the above arrangement, even if ink spills from the atmosphere communication chamber 15 as well as leaks from the ink supply path 206 on the recording head 201 side in the state in which the main tank 204 is mounted, the second flow path 13*b* is not filled with ink. This is because when the ink flows with the first flow path 13*a* filled with the ink, the flow rate of the ink is determined by the sectional area of the first flow path 13*a* and a water head difference due to the leakage of ink. Accordingly, a principle of siphon does not work because an air/liquid replacable state is maintained in the second flow path 13*b*, from which an effect can be obtained in that the ink in the main tank 204 does not entirely flow out.

How exhausted waste ink is treated will be explained supplementarily.

Conventionally, an inkjet recording apparatus main body must be provided with a waste ink absorbing member having a large capacity to keep the ink wasted in a recording head recovery operation. Further, conventionally, an absorbing member having a small capacity is provided to keep a minute amount of ink spilled from an atmosphere communication port due to a temperature change. However, to cope with a change of attitude of the inkjet recording apparatus occurring in transportation, and the like, an absorbing member must have a considerably large capacity because the amount of ink, which leaks from the atmosphere communication port, is comparable to the entire amount of ink.

To solve the above problem, in the embodiments, the atmosphere communication port 14 and the atmosphere port 25 have flow paths prepared for respective colors, respectively, and these flow paths for the respective colors are connected to the waste ink absorbing member 10 of the recording head 201.

A situation, in which a large amount of ink leaks, is a very rare case which occurs, when, for example, a faulty recording apparatus is accommodated in an easily available box and transported in a sideways or upset state by a truck for a long time. Accordingly, no problem arises even if the capacity of the recording head recovery waste ink absorbing member is entirely expended. Even if the capacity of the absorbing member is entirely expended, it can be replaced when the recording apparatus is repaired. That is, the waste ink absorbing member 10 is arranged as an ink holding member having two functions, i.e., an ordinary function as a recording head recovery waste ink absorbing member and a function as a leaked ink absorbing member when a recording apparatus fails by any chance, thereby leakage of ink occurring in transportation can be coped with without a special arrangement.

Waste ink flow paths can be formed independently to the respective colors just before they reach the ink absorbing member as shown in FIGS. 5A and 5B.

This is because when temperature and pressure repeatedly change in an inverse direction, there is a possibility that the ink flowed out from an atmosphere valve is absorbed again into the flow paths through the atmosphere valve, and thus when the flow paths are connected to each other, the respective colors are mixed with each other. It is possible to recover the mixed colors by the recovery operation of the recording head. However, in a recording system making use of the chemical reaction of ink, the flow paths may be clogged by a substance firmly adhered by reaction. Because of the reasons described above, the flow paths can be separated to the respective colors just before they reach the absorbing member.

Further, the outlets of the flow paths and the absorbing member can be arranged to prevent leakage of ink even if they are inclined in any direction. At the time, the internal pressure of the flow paths can be easily arranged by permitting air to enter and exit from the flow paths in place of arranging them as hermetically sealed space.

As an arrangement for realizing the above state, it is contemplated to cause the flow paths to come into contact with the absorbing member and to partly cut out the contact portions of them so that air leaks from the flow paths but ink is absorbed by the absorbing member by a capillary phenomenon occurring in the vicinity of the cut-out portions before it leaks to the outside.

With the arrangement described above, leaked ink can be effectively collected.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-031990 filed Feb. 9, 2004, which is hereby incorporated by reference herein.

What is claimed is:

1. An inkjet recording apparatus comprising:

a detachable ink tank adapted to accommodate ink;

a recording head;

an ink supply path coupled to the recording head;

an atmosphere communication portion communicating with an atmosphere;

first and second hollow needles, wherein the ink tank is configured to attach to and detach from the first and second hollow needles, wherein in an attached state in which the ink tank is attached to the first and second needles, the atmosphere communication portion communicates with the ink tank via the second hollow needle and the ink supply path communicates with the ink tank via the first hollow needle so that a single flow hermetically sealed path is provide between the recording head to the atmosphere communication portion;

a first switching valve sealing the first hollow needle from the ink supply path in a detached state in which the ink tank is detached from the first and second hollow needles;

a second switching valve sealing the second hollow needle from the atmosphere communication portion in the detached state of the ink tank;

a waste ink collection unit configured to collect waste ink;

the ink supply path including an opening facilitating introducing the waste ink into the waste ink collection unit; and a third switching valve configured to seal the opening in the attached state of the ink tank, and to release the opening in the detached state of the ink tank.

2. An inkjet recording apparatus according to claim 1, further comprising an absorbing member, wherein the waste ink collection unit and the absorbing member collect the waste ink generated by a recording head recovery treatment.

3. An inkjet recording apparatus according to claim 1, wherein the ink tank accommodates different color inks, wherein the ink supply path includes an independent ink supply path for each of the different color inks, and wherein the recording head is configured to selectively discharge the different color inks.

4. An inkjet recording apparatus according to claim 1, further comprising:

seal members;

a movable plate supporting the seal members; and an elastic member providing a force to the movable plate, wherein in the attached state of the ink tank, the ink tank moves the movable plate such that the movable plate compresses the elastic member and moves the sealing members to seal the opening, and wherein in the detached state of the ink tank, the elastic member provides the force to move the movable plate so that the sealing members move to seal the first and second hollow needles.

5. An inkjet recording apparatus according to claim 1, wherein the atmosphere communication portion includes a chamber, a first path communicating with the chamber and having a first cross sectional area S1, a port communicating with the atmosphere, and a second path communicating between the first path and the port and having a second cross sectional area S2, and wherein 2S1≦S2.

6. An inkjet recording apparatus according to claim 1, further comprising a seal member, wherein the first hollow needle includes a second opening, wherein in the attached state of the ink tank, the sealing member seals the second opening, and wherein in the detached state of the ink tank, the second opening communicates with the ink flow path.

* * * * *